United States Patent [19]

Cuttriss

[11] Patent Number: 5,050,252

[45] Date of Patent: Sep. 24, 1991

[54] UNIVERSAL ADJUSTABLE GRAB BAR ASSEMBLY

[75] Inventor: Rik Cuttriss, Fillmore, Calif.

[73] Assignee: Gruber Systems, Inc, Valencia, Calif.

[21] Appl. No.: 567,920

[22] Filed: Aug. 14, 1990

[51] Int. Cl.[5] ..... A47K 3/12

[52] U.S. Cl. ..... 4/576; 211/105.2; 248/201; 248/558; 4/611

[58] Field of Search ..... 4/571, 573, 576, 577, 4/605, 604, 611, 504; 211/105.1, 105.2, 105.3, 95, 175, 182; 248/251, 201, 558; 312/242, 245; 16/110 R, 111 R, 113, 125, DIG. 19, DIG. 12, DIG. 41; 74/551.1, 551.3, 551.9

[56] References Cited

U.S. PATENT DOCUMENTS

| | | | |
|---|---|---|---|
| D. 118,014 | 12/1939 | Grimm | 23/277 |
| D. 173,415 | 11/1954 | DuBrie | 4/577 X |
| D. 188,175 | 6/1960 | Craig et al. | 4/576 X |
| D. 189,906 | 3/1961 | Best et al. | 4/576 X |
| D. 211,877 | 8/1968 | Doman | D23/277 |
| D. 233,756 | 11/1974 | Schrock | D23/277 |
| D. 282,963 | 3/1986 | Alger | D23/277 |
| 1,311,635 | 7/1919 | Baker | 4/576 X |
| 1,704,639 | 3/1929 | Thompson | D23/277 X |
| 2,005,576 | 6/1935 | Buhl et al. | 4/577 |
| 2,058,188 | 10/1936 | Stanton | 4/577 |
| 2,430,027 | 11/1947 | Morrison | 4/577 |
| 3,098,240 | 7/1963 | Fleenor | 4/576 |
| 3,156,977 | 11/1964 | Logan | 211/105.2 X |
| 3,568,220 | 3/1971 | Dees | 4/576 |
| 3,968,524 | 7/1976 | Zentman | 4/577 |
| 4,034,425 | 7/1977 | Van Riemsdyck | 4/576 |
| 4,319,687 | 3/1982 | Hull | 211/105.2 |
| 4,417,361 | 11/1983 | Smith | 4/577 |
| 4,706,311 | 11/1987 | Jarosinski | 4/577 |
| 4,887,323 | 12/1989 | DiVito et al. | 4/577 |
| 4,908,906 | 3/1990 | Hanna | 4/576 |
| 4,912,808 | 4/1990 | Blakely | 16/125 X |
| 4,987,619 | 1/1991 | Smith | 4/604 X |

FOREIGN PATENT DOCUMENTS

| | | | |
|---|---|---|---|
| 2405599 | 8/1975 | Fed. Rep. of Germany | 4/576 |
| 3140556 | 4/1983 | Fed. Rep. of Germany | 4/611 |
| 2599410 | 12/1987 | France | 16/113 |
| 357167 | 11/1961 | Switzerland | 16/125 |

*Primary Examiner*—Henry J. Recla
*Assistant Examiner*—Glenn T. Barnett
*Attorney, Agent, or Firm*—Poms, Smith, Lande & Rose

[57] ABSTRACT

An adjustable and universal grab bar assembly for a tub or the like. The bar assembly includes a bar having a relatively straight central portion and angled ends. The ends rotate within end holders bolted or otherwise secured to the wall of a tub or the like. The configuration of the end holders, and the angularity of the angled ends, is such that the grab bar assembly may be mounted to irregularly shaped surfaces, such as curved, angled, etc., yet provide a suitable space between the bar and the surface to enable a user to grasp the same.

26 Claims, 3 Drawing Sheets

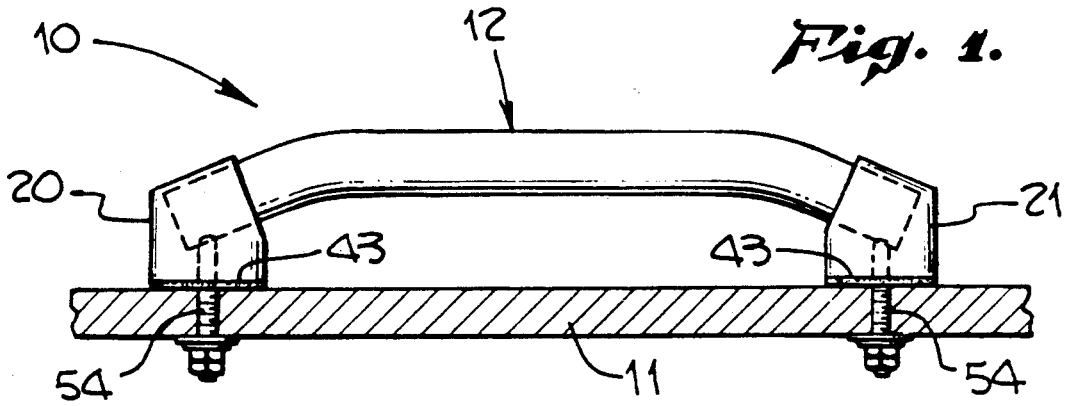
Fig. 1.
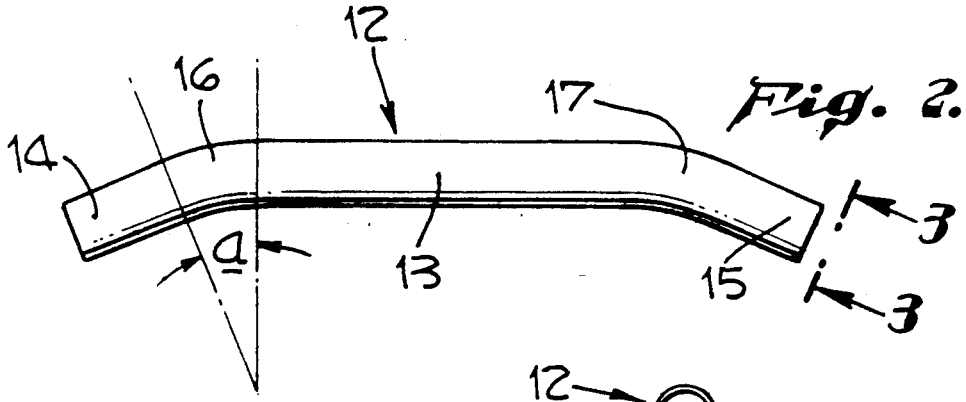
Fig. 2.
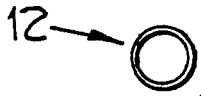
Fig. 3.
Fig. 4.
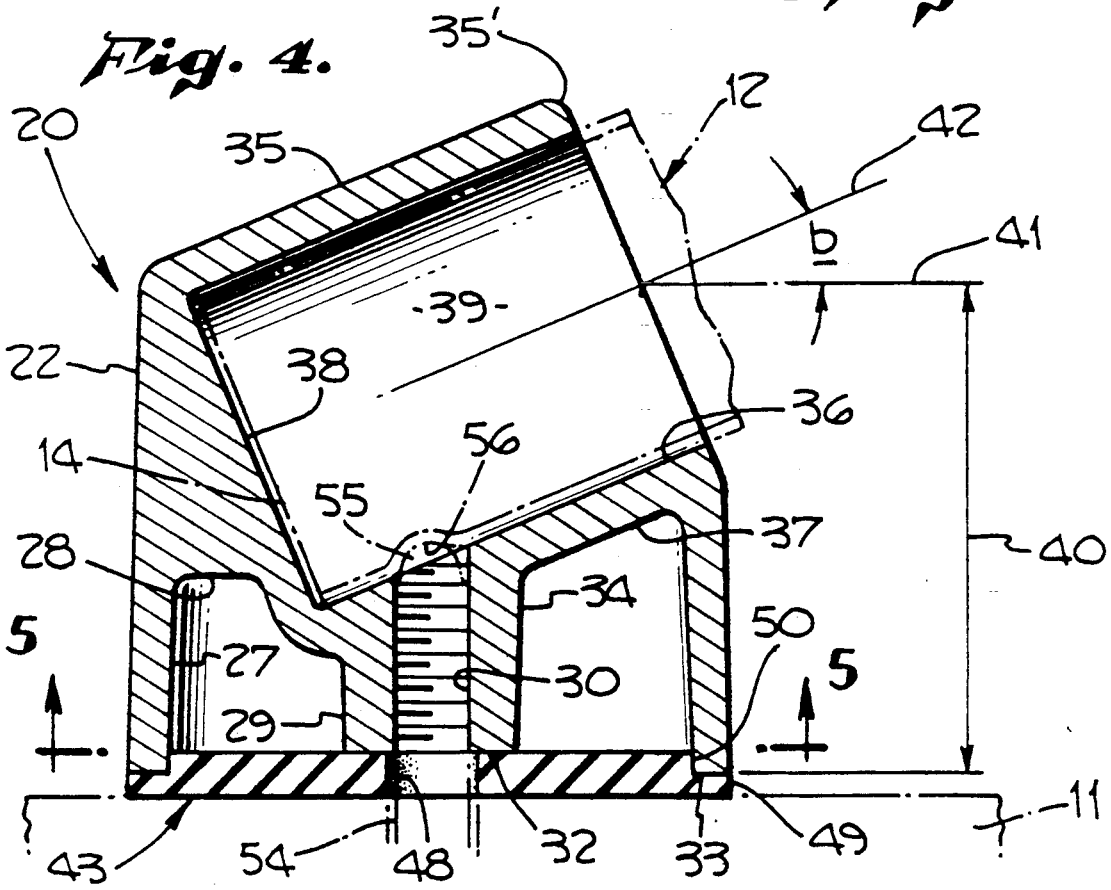

Fig. 5.
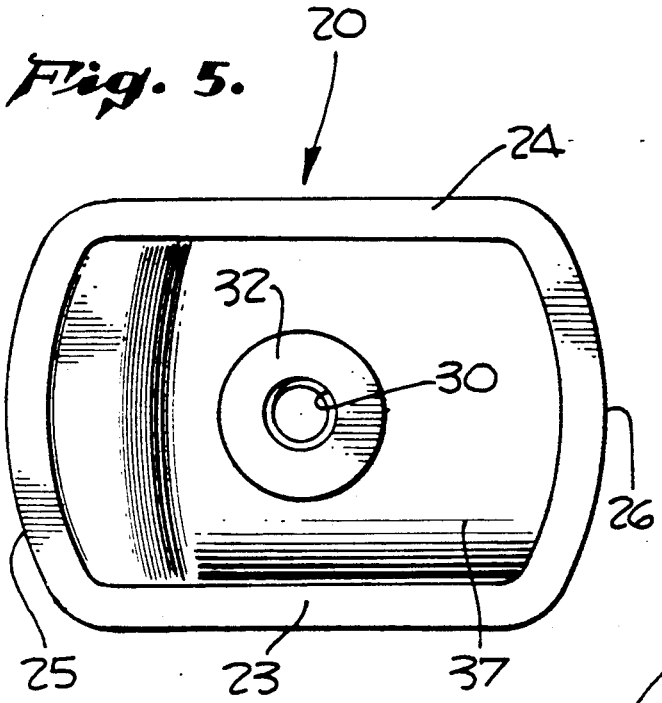
Fig. 6.
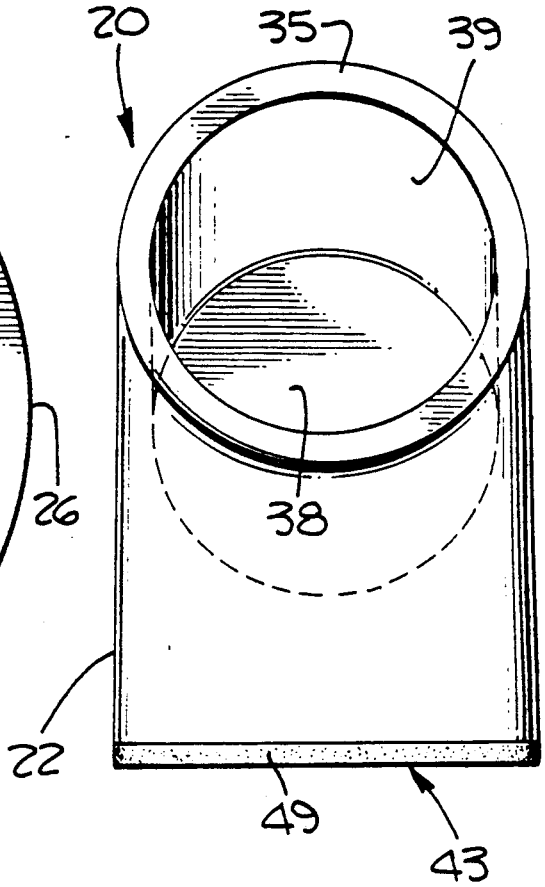
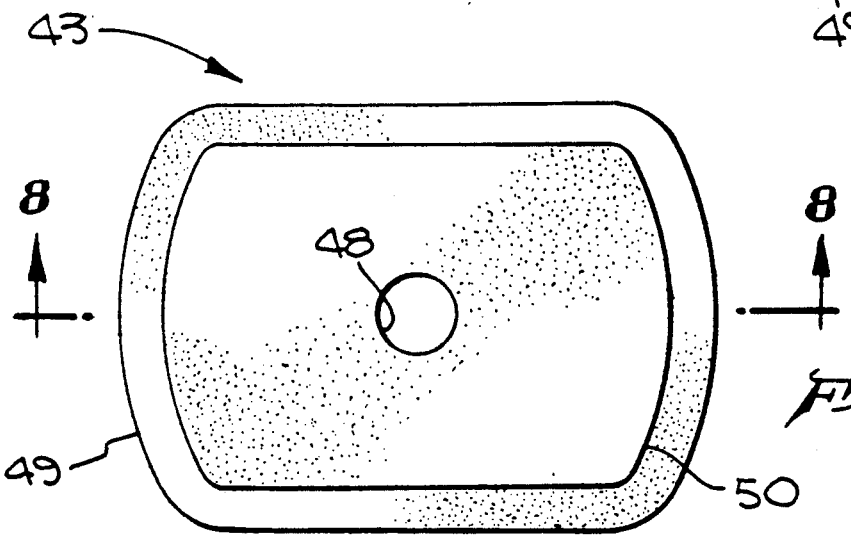
Fig. 7.
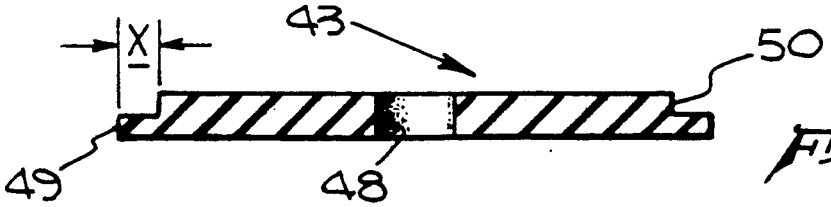
Fig. 8.

Fig. 9.
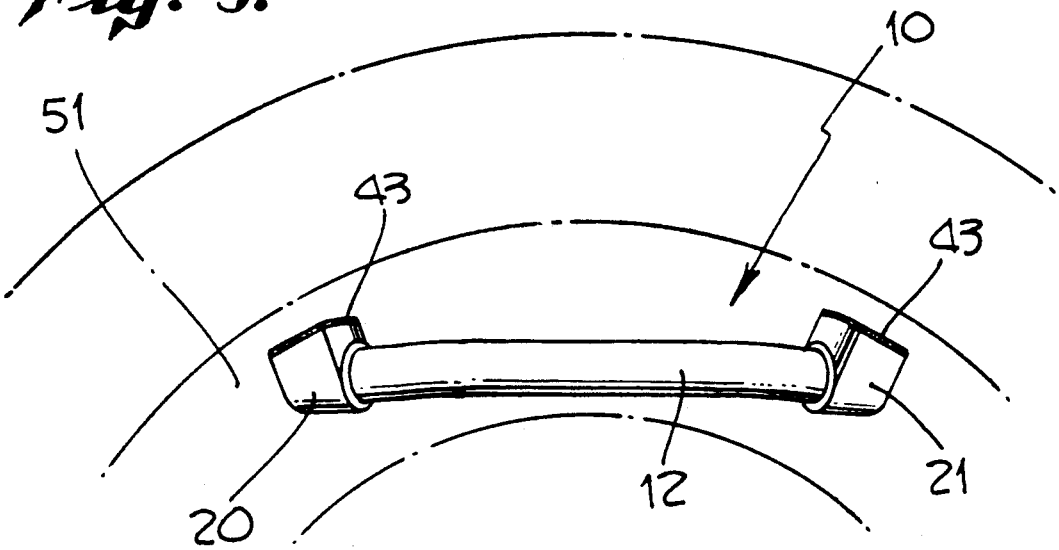
Fig. 10.
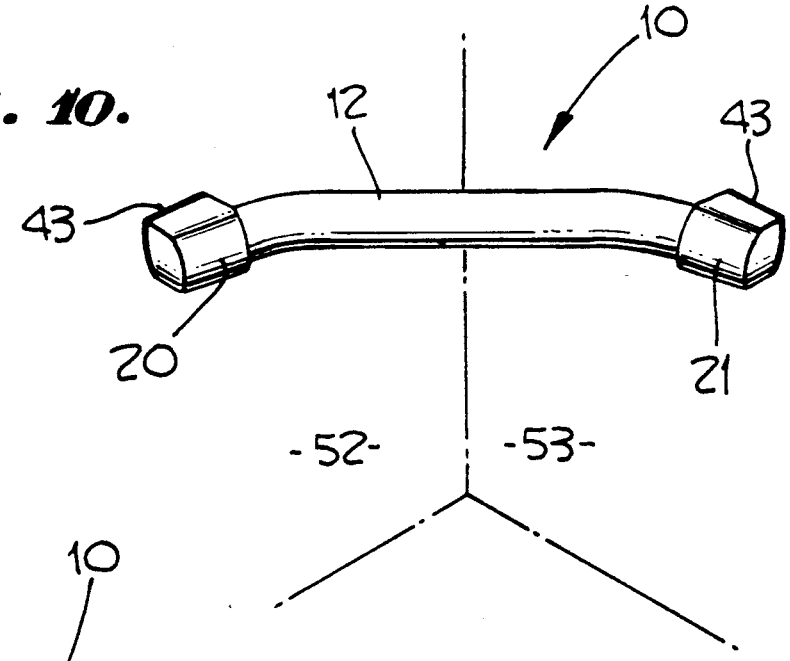
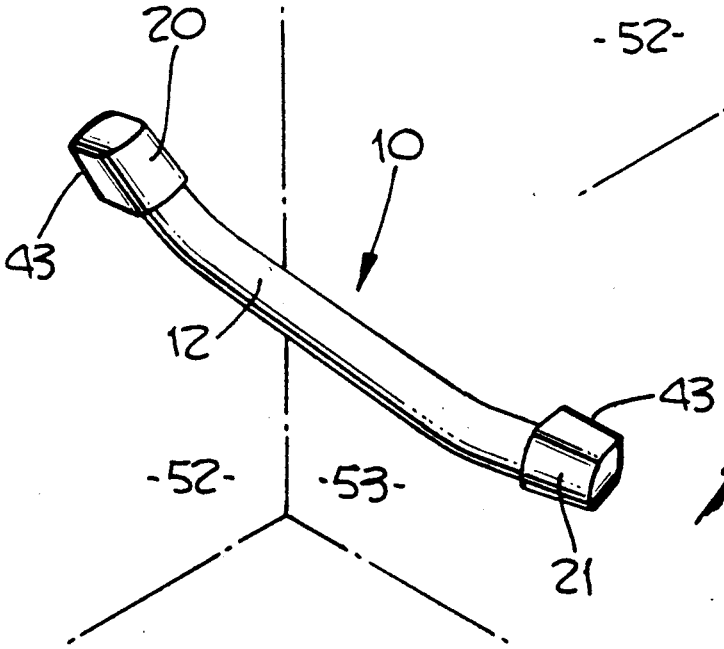
Fig. 11.

UNIVERSAL ADJUSTABLE GRAB BAR ASSEMBLY

BACKGROUND OF THE INVENTION

1. Field of the Invention

The invention relates to grab bar assemblies; and, more particularly, to a grab bar assembly attachable to the side of a tub, such as a bathtub, for providing a support for assistance in entering and exiting the tub.

2. Description of the Prior Art

Grab bars are known in the art which are mounted to the side wall of a tub to assist a user to get into and out of the tub. However, all tubs are not alike and have side walls, to which such bars are usually secured, of varying curvatures. Thus, grab bars for such tubs, for example, spas, jacuzzis, bathtubs, etc., must be individually manufactured to provide the proper mounting for the particular side wall curvature of the tub to which the grab bar is to be mounted.

There thus exists a need for a universal adjustable grab bar assembly which can be mounted to any surface yet provide the proper spacing between the grab bar and the mounting surface for grasping the same.

SUMMARY OF THE INVENTION

It is an object of this invention to provide an adjustable universal grab bar assembly for a tub or the like which can be mounted to any desired surface.

It is a further object of this invention to provide an adjustable universal grab bar assembly which can be mounted to any adjacent surfaces to provide a spaced bar which can be grasped by a user to assist the user in supporting him or herself.

These and other objects are preferably accomplished by providing a bar assembly including a bar having a relatively straight central portion and angled ends. The ends rotate within end holders bolted or otherwise secured to the wall of a tub or the like. The configuration of the end holders, and the angularity of the angled ends, is such that the grab bar assembly may be mounted to irregularly shaped surfaces, such as curved, angled, etc., yet provide a suitable space between the bar and the surface to enable a user to grasp the same.

BRIEF DESCRIPTION OF THE DRAWING

FIG. 1 is a top plan partly sectional view of a grab bar assembly mounted to a mounting surface;

FIG. 2 is a plan view of the grab bar alone of the assembly of FIG. 1;

FIG. 3 is a view taken along lines 3—3 of FIG. 2;

FIG. 4 is a vertical cross-sectional view of one of the end holders of the assembly of FIG. 1 with the washer of FIG. 1 installed thereon;

FIG. 5 is a view taken along lines 5—5 of FIG. 4;

FIG. 6 is a front vertical view of the holder of FIGS. 4 and 5;

FIG. 7 is a top plan view of the washer alone of FIG. 1;

FIG. 8 is a view taken along lines 8—8 of FIG. 7; and

FIGS. 9 to 11 are illustrative views of the mounting of the assembly of FIGS. 1 to 8 to various surfaces.

DESCRIPTION OF THE PREFERRED EMBODIMENT

Referring now to FIG. 1 of the drawing, a grab bar assembly 10 is shown mounted to the side wall 11 of a tub or the like. Grab bar assembly 10 includes an elongated grab bar 12 having a generally straight midportion 13 (see also FIG. 2) with downwardly angled ends 14, 15 interconnected by elbow portions 16, 17, respectively. Midportion 13 may be about 5.875" in overall length with ends 14, 15 about 1.75" in overall length.

As seen in FIG. 2, line 18, at the intersection of end 14 and portion 16 and perpendicular to the central longitudinal axis of end 14, may make an angle a of about 22°30' with line 19, at the intersection of portion 16 and midportion 13 and perpendicular to the central longitudinal axis of midportion 13. Line 18 may make a radius of curvature of about 3" from its intersection with line 19 to bar 12. The angularity of end 15, portion 17, and midportion 13 may be identical.

As seen in FIG. 3, bar 12 may be hollow having an outer diameter of about 1 inch and a wall thickness of about 32 thousandths of an inch.

The ends 14, 15 are receivable in end holders 20, 21, respectively. End holders 20, 21 are identical and, thus, end holder 20 in FIG. 4 may have an outer peripheral wall 22 comprised of spaced generally straight front and rear walls 23, 24 (FIG. 5) interconnected by curved end walls 25, 26, respectively (the points of connection being curved as seen in FIG. 5). As seen in FIG. 4, inner wall 27 is spaced from outer wall 22, the thickness thereof being about 0.125". As seen in FIG. 6, side 22 may slope inwardly at an angle of about 1° to the vertical.

Looking again at FIG. 4, inner wall 27 extends first generally vertically upwardly to upper inner annular lower partition wall 28 which, at the front (to the right in FIG. 4), curves downwardly. Wall 28 surrounds a boss 29 having a tapped throughbore 30. The bottom annular wall 32 of boss 29 lies in a horizontal plane spaced from the horizontal plane of the bottom annular wall 33 of holder 20 (e.g., a distance of about 0.062 inches). Also, the peripheral side wall 34 of boss 29 may taper downwardly and inwardly toward the central axis thereof, e.g., about 2° with respect to the vertical.

Wall 22 at the rear of holder 20 extends upwardly to a top wall 35 (domed or arced at top as seen in FIG. 6) and rounded at a radius of about 1/16 of an inch. Top wall 35 is spaced from upper partition wall 36 which, together with annular lower partition wall 28, forms a partition wall 37.

Walls 35, 36 form an opening at the front (or right side in FIG. 4) of holder 20 which opening is closed off at the rear by a slanted rear wall 38. Walls 35, 36 and 28 thus provide a socket 39 for receiving end 14 therein, as will be discussed. As seen in FIG. 6, socket 39 is at least slightly greater in its smallest diameter than the outer diameter of bar 12, e.g., at least 5/1000ths of an inch greater.

Although any suitable dimensions may be used, in conformity to the dimensions heretofore given for grab bar 12, holder 20 may be about 1.749 inches long (from front to rear) and about 1.25 inches wide. The distance from the bottom wall 33, as indicated by line 40, to a horizontal line 41 intersecting with both the plane of the opening of socket 39 (indicated by line 57) and the central longitudinal axis 42 of socket 39 (at the front or right side in FIG. 4) may be about 1.422". This angle of intersection b may be about 22°30'. As heretofore mentioned, the inner smaller diameter of socket 39 may be about 1.005 inches. This allows free rotation of bar 12 in holders 20, 21. The outer diameter of holder 20 (between the outside of top wall 35 and the outside of wall 37 (at the front end or right side in FIG. 4) may be about 1.25".

The length of wall 35 may be about 1.375" (to its intersection with wall 22). All edges may be rounded, as shown at 35'. As seen in FIG. 5, holder 20 may be slightly wider at the front end (right side in FIG. 5) than at the rear end (left side in FIG. 5) thereof (e.g., varying from a width of about 1.299 inches at the front to about 1.281 inches at the rear). The semi-elliptical side 26 blends with flat sides 23, 24 to the smaller semi-elliptical side 25. These sides 25, 26 are based on two 22°30' semi-ellipses, the left side 25 being smaller than the right end 26. Boss 29 may be about ½" in outer diameter with a ¼" tapped hole therethrough.

Any suitable materials may be used, such as brass alloy. The brass alloy may have a smooth outer finish for plating purposes and, thus, may be plated with polished chrome or any other suitable finish such as antique brass. Of course, the dimensions will vary depending on tolerances, plating, finishing, etc.

Although the 1.005 inches inner diameter of inclined socket 39 is preferred, this too can vary. However, it must be of sufficient diameter to receive therein end 14 (which, as heretofore mentioned, may be one inch in diameter).

Bar 12 (and thus ends 14, 15) may also be of brass alloy and may also be chrome plated or finished in any other suitable manner, such as antique brass. Ends 14, 15 must slide into sockets 39 in an easy sliding fit with minimum looseness.

As seen in FIG. 1, a washer 43 (see also FIGS. 7 and 8) is provided between each holder 20, 21 and side 11. As seen in FIG. 7, washer 43 is similarly configured to the bottom plan view of holder 20, as seen in FIG. 5. Thus, each washer 43 has a right end semi-elliptical side wall 44 blending into straight side walls 45, 46 which then blend into left end semi-elliptical side 47. Each end 44, 47 is again based on two 22°30' ellipses and washer 43 may be about 1.789" long and about 1.299" wide (at end 44) and about 1.281" wide (at end 47). A hole 48, about 0.265" in diameter, is provided through washer 43. As seen in FIG. 8, washer 43 is about 0.125" in thickness and is comprised of a lower section defined by flange 49 which is wider than an upper section (defined by peripheral wall 50—see also FIG. 7). Flange 49 may be about 0.062" thick and the distance x in FIG. 8 may be about 0.531".

Washer 43 may be of any suitable material, such as rubber, soft vinyl or any suitable plastic. It should be of a material sufficient to resist deterioration when submerged in water. The outer flange 49 will be under compression in use and washer 43 must be flexible and of a medium hardness.

Referring once again to FIG. 4, washer 43 is placed over the bottom of each holder, such as holder 20. The reduced diameter portion of washer 43, defined by wall 50, enters into the interior of holder 20 and abuts against the bottom wall 32 of boss 29. Hole 48 aligns with hole 30. The thickness of the reduced diameter portion of washer 43, defined by wall 50, is related to the distance between wall 32 of boss 29 and bottom wall 33. Thus, the outer diameter of wall 50 is generally related to the inner diameter of wall 27 and conforms thereto. The outer diameter of flange 49 conforms to the outer configuration and diameter of outer wall 22.

The means for mounting each holder 20, 21 to the application, such as side wall 11, will obviously depend upon the installation and access to the blind side of the wall 11.

In operation, each holder 20, 21 is slid onto the ends 14, 15 of grab bar 12 and are free to rotate 360°. Two identical shaped washers 43 are now mounted onto the bottom of each holder 20, 21, as heretofore discussed, and act as interface cushioning means between holders 20, 21 and the installation (such as wall 11). The holders 20, 21 are now mounted to the installation, such as wall 11, as heretofore discussed.

As seen in FIG. 4, a screw 54 is threaded through wall 11 and then threaded into tapped throughbore 30 in each holder 20, 21. The tip 55 of screw 54 digs into the end 14 forming a dimple 56 therein which serves to retain bar 12 in non-rotating position in holders 20, 21 (of course, after rotating bar 12 to the desired position for the application as will further be discussed).

FIG. 1 illustrates the bar assembly 10 mounted to a flat surface. In FIG. 9, bar 12 has been rotated slightly in holders 20, 21 allowing the holders 20, 21 to be mounted to a sharply curved wall 51. As can be seen, the bottom flat surface 33 of each holder conforms as much as possible to the plane of the curved contacting surface which is accomplished by rotation of bar 12. In FIGS. 9–11, the washers 43 have been omitted for convenience of illustration. The bar assembly 10 can thus be mounted to a curved surface, the orientation of the bar 12 varying depending upon the place of mating between surface 43 (or surfaces 33 if washer 43 is eliminated) and the installation wall.

As seen in FIGS. 10 and 11, the assembly 10 can even be mounted between two flat surfaces 52, 53, making an angle of 90°. As seen in FIG. 10, bar 12 is oriented such that ends 14, 15 extend away from the surfaces 52, 53 directly opposite the assembly in FIG. 1 where ends 14, 15 extend toward surface 11. In FIG. 11, one end 14 may extend inwardly and one end may extend away. These adaptations of assembly 10 to such surfaces is accomplished by rotation of bar 12, or one or both ends 14, 15, or a combination of rotation of bar 12 and one or both of ends 14, 15.

Thus, FIG. 10 shows bar 12 mounted against an inside 90° corner such as typically found in a rectangular shower. The two end holders 20, 21 have been rotated 180° each from the position shown in FIG. 1. Bar 12 is installed generally parallel to the floor with the ends 14, 15 set at the same distance from the corner.

In FIG. 11, bar 12 is asymmetrically disposed across the same 90° corner as in FIG. 10, but in a randomly selected position. Thus, using the unique geometry of the angled ends of bar 12, and the identical angle of the sockets 39 in each holder 20, 21 relative to a horizontal datum plane indicated by line 41 in FIG. 4, the bar 12 can be mounted to a variety of straight, curved and angled surfaces. That is, by combining the rotational characteristics between bar 12 and holders 20, 21, bar 12 can be mounted to a great number of concave, curved, warped, flat and angled surfaces (of course, angled surfaces less than 180°).

As heretofore noted, bar 12 and holders 20, 21 may be of any suitable materials. For example, a spacing of 1½" between bar 12 and the mounting surface is preferred. Although a 1" outer diameter bar 12 has been discussed as preferred, obviously bar 12 (and, of course, socket 39) can take other dimensions, such as an O.D. for bar 12 of about 1¼" to 1½".

The angle of 22°30' for ends 14, 15 and holders 20, 21 may, of course, vary but is preferred for most efficiently carrying out the teachings of the invention. Bar assembly 10 may have a variety of applications, but primarily may be used to assist one in getting in and out of a tub, spa, bath, etc.

Although a particular mechanical connection of holders 20, 21 to the mounting surface or wall 11 in FIG. 1 has been disclosed, obviously holders 20, 21 may be secured to the mounting surface in any suitable manner, such as by use of suitable adhesives. In the invention disclosed herein, if a 250# load is placed on bar 12 at the middle portion 13 thereof, it will not rotate beyond 1/16th of 360°.

Washer 43 allows a flush fit of the holders 20, 21 and the screw 54, forming a dimple 56 in ends 14, 15, providing an interlock between bar 12 and holders 20, 21, preventing rotation after installation. Washer 43, in addition to providing an interface for a flush fit between the holders 20, 21, which may be metallic, cushions the edges of the holders 20, 21 with respect to side wall 11 (or any other installation surface).

Brass is preferred because it is platable, ductile and non-corroding. Dimple 56 can be formed in a hollow brass tube, as bar 12, without rupturing.

There is thus disclosed a grab bar assembly which can be quickly and easily assembled to any surface or mating surfaces at an angle of 180° or less.

I claim:

1. An adjustable and universal grab bar assembly for attachment to a surface comprising:

a bar having a cross section, a generally straight midportion having a central axis and angled and portions located at opposite ends of said midportion, each of said angled end portions having a central longitudinal axis;

a pair of holders, each of said holders having a main body portion with a top and bottom, said main body portion including a socket formed therein, said socket having an interior and a central longitudinal axis whereby said central axis of said socket forms a first angle with a line parallel to the bottom of the main body portion; and a line perpendicular to the central longitudinal axis of said angled end portions forms a second angle with a line perpendicular to the central axis of said midportion wherein said first and second angles being substantially the same and approximately equal to 22°30′, said bar and said holders being configured such that said bar can be rotated within said sockets to change the orientation of said midportion with respect to said holders.

2. In the assembly of claim 1 wherein said main body portion has a throughbore therethrough communicating the bottom thereof with the interior of said socket.

3. In the assembly of claim 1 wherein said bottom is a generally flat wall adapted to be mounted to a supporting surface, said top being an angled top wall extending from a peripheral side wall integral with said bottom.

4. In the assembly of claim 3 including a centrally located annular boss in said main body portion, said boss having a throughbore communicating at one end with the interior of said socket and at another end with said bottom.

5. In the assembly of claim 4 wherein said boss terminates in a lowermost bottom wall spaced from said flat wall of said bottom.

6. In the assembly of claim 4 wherein said flat wall has a right end semi-ellipse end wall having a length, a pair of generally linearly extending side walls connected to opposite ends of said end wall, and a left end semi-ellipse end wall having a length and its opposite ends connected to free ends of said side walls.

7. In the assembly of claim 6 including a resilient washer configured substantially to the configuration of said flat wall mounted thereto.

8. In the assembly of claim 7 wherein said flat wall is an annular wall having an interior and an exterior, said washer having a first portion of a diameter configured to the interior of said flat wall and configured similarly thereto and a second portion of a diameter configured to the exterior of said flat wall.

9. In the assembly of claim 8 wherein said boss terminates in a lowermost bottom wall spaced from said flat wall of said bottom, said first portion of said washer being substantially the same thickness as the spacing between said lowermost bottom wall and said flat wall.

10. In the assembly of claim 6 wherein the overall length of said left end is slightly less than the overall end of said right end.

11. In the assembly of claim 1 wherein said bar and said holders are made of brass.

12. In the assembly of claim 1 wherein said bar is about 1 to 1½″ in outer diameter and said socket is about 5/1000ths of an inch greater in diameter than the outer diameter of said bar.

13. In the assembly of claim 1 where the midportion of said bar is about 5.875″ long, said end portions having a length of about 1.75″, and elbows of equal lengths interconnect each of said ends to said midportion.

14. An adjustable and universal grab bar assembly mounted to a supporting surface comprising:

a bar having a cross section a generally straight midportion having a central axis and angled end portions located at opposite ends of said midportion, each of said angled end portions having a central longitudinal axis;

a pair of holders adapted to be mounted to said supporting surface, each of said holders having a main body portion with a top and bottom, said main body portion including a socket formed therein, said socket having an interior and a central longitudinal axis whereby said central axis of said socket forms a first angle with a line parallel to the bottom of the main body portion;

a line perpendicular to the central longitudinal axis of said angled end portions forms a second angle with a line perpendicular to the central axis of said midportion wherein said first and second angles being substantially the same and approximately equal to 22°30′ said bar and said holders being configured such that said bar is rotatable within said socket to change the orientation of said midportion with respect to said holders;

each of said main body portions having an aperture therethrough; and securing means extending through said surface and into said apertures for securing said holders to said surface.

15. In the assembly of claim 14 wherein said securing means includes a screw having a head on one side of said surface and a threaded shank extending through an aperture in said surface and into said apertures in said main body portions and threaded therein.

16. In the assembly of claim 14 wherein said bottom is a generally flat wall mounted to said supporting surface, said top being an angled top wall extending from a peripheral side wall integral with said bottom.

17. In the assembly of claim 16 including a centrally located annular boss in said main body portion, said boss having a throughbore communicating at one end with the interior of said sockets and at another end with said bottom.

18. In the assembly of claim 17 wherein said boss terminates in a lowermost bottom wall spaced from said flat wall of said bottom.

19. In the assembly of claim 17 wherein said flat wall has a right end semi-ellipse end wall having a length, a pair of generally linearly extending side walls connected to opposite ends of said end wall, and a left end semi-ellipse end wall having a length and its opposite ends connected to free ends of said side walls.

20. In the assembly of claim 19 including a resilient washer configured substantially to the configuration of said flat wall mounted between said flat wall and said supporting surface.

21. In the assembly of claim 20 wherein said flat wall is an annular wall having an interior and an exterior, said washer having a first portion of a diameter configured to the interior of said flat wall and configured similarly thereto and a second portion of a diameter configured to the exterior of said flat wall.

22. In the assembly of claim 21 wherein said boss terminates in a lowermost bottom wall spaced from said flat wall of said bottom, said first portion of said washer being substantially the same in thickness as the spacing between said lowermost bottom wall and said flat wall.

23. In the assembly of claim 19 wherein the overall length of said left end is slightly less than the overall length end of said right end.

24. In the assembly of claim 14 wherein said bar and said holders are made of brass.

25. In the assembly of claim 14 wherein said bar is about 1 to 1½″ in outer diameter and said socket is about 5/1000ths of an inch greater in diameter than the outer diameter of said bar.

26. In the assembly of claim 14 wherein the midportion of said bar is about 5.875″ long, said end portions having a length of about 1.75″, and elbows of equal lengths interconnect each of said ends to said midportion.

* * * * *

UNITED STATES PATENT AND TRADEMARK OFFICE

CERTIFICATE OF CORRECTION

PATENT NO. : 5,050,252

DATED : September 24, 1991

INVENTOR(S) : Rik Cuttriss

It is certified that error appears in the above-identified patent and that said Letters Patent is hereby corrected as shown below:

Col. 5, line 31, change "and" (2nd occurrence) to --end--.

Col. 6, line 34, after "section", insert -,-.

Signed and Sealed this

Fifth Day of January, 1993

*Attest:*

DOUGLAS B. COMER

*Attesting Officer*

*Acting Commissioner of Patents and Trademarks*